United States Patent [19]

Graham et al.

[11] 4,157,027

[45] Jun. 5, 1979

[54] SPOOL STRAIGHTENING APPARATUS

[76] Inventors: Robert J. Graham, 640 N. Meridian, Oklahoma City, Okla. 73107; Jimmy D. Archer, Box 225U, Blanchard, Okla. 73010

[21] Appl. No.: 866,218

[22] Filed: Jan. 3, 1978

[51] Int. Cl.[2] ..... B21D 1/06

[52] U.S. Cl. ..... 72/403; 29/401 R; 72/452

[58] Field of Search ..... 72/403, 355, 399, 394, 72/452; 29/401 R, 159.1, 159.3, 159 R; 113/120 M

[56] References Cited

U.S. PATENT DOCUMENTS

| | | | |
|---|---|---|---|
| 58,963 | 10/1866 | Shipton | 72/394 |
| 517,738 | 4/1894 | Edgar | 113/120 M |
| 1,706,118 | 3/1929 | Hopkins | 29/159 R |
| 3,466,921 | 9/1969 | Steiniger | 72/393 |

*Primary Examiner*—C. W. Lanham
*Assistant Examiner*—Gene P. Crosby
*Attorney, Agent, or Firm*—Laney, Dougherty, Hessin & Beavers

[57] ABSTRACT

Apparatus for straightening metal flanges of a cylindrical spool having a center longitudinal portion with a planar flange perpendicularly mounted upon each end thereof. The apparatus includes a pair of movable jaw assemblies which first engage the center longitudinal portion of the spool and then expand to provide a rigid support adjacent the inner planar surfaces of the spool flanges. A hydraulic control system is provided which senses the fully extended engagement of the movable jaw assemblies with the spool, and then actuates a hydraulic press to engage the outer surfaces of the spool flanges. The flanges are compressed between the movable jaw assemblies and the hydraulic press, thereby straightening out irregularities in the flanges. A second sensing device detects when the hydraulic press has reached its fully extended position and then actuates a control system which retracts both the movable jaw assemblies and the hydraulic press, thereby releasing the spool and resetting the system for the next cycle.

25 Claims, 7 Drawing Figures

SPOOL STRAIGHTENING APPARATUS

BACKGROUND OF THE INVENTION

1. Field of the Invention

This invention relates generally to apparatus for straightening flanges upon spools, and more particularly, but not by way of limitation, to apparatus for straightening metal flanges upon a relatively large cylindrical spool.

2. Description of the Prior Art

The general method for packaging, storing and transporting large diameter cables or heavy wire is to wind the cable or wire upon a relatively large cylindrical spool having a center longitudinal portion with a planar flange perpendicularly mounted upon each end thereof. Many of these spools are entirely made of metal or have metal flanges. When used in the field, or in shipping, the flanges on the spools often become dented, bent or in other ways distorted. The value of these spools is such that it is desirable to reuse them, but in order to do so it is necessary to repair the flanges to return them to a relatively smooth planar shape. Failure to do so creates difficulties in the process of winding new cable or wire upon the spool.

The prior art has generally involved cumbersome manual methods of repairing these flanges. Such methods generally involved a manual placement of an anvil or some other rigid support under the inner planar surface of the flange, followed by an exertion of force upon the outer planar surface of the flange by means of a hydraulic press, manual hammering, or similar means. While fairly satisfactory for the repair of small numbers of such spools, the methods of the prior art are impractical and uneconomical when large numbers of damaged spools are involved. We have invented an automated spool straightening apparatus which will perform the same function in a much more uniform and economical manner.

SUMMARY OF THE INVENTION

This invention provides apparatus for straightening flanges of a spool, particularly metal flanges on relatively large cylindrical spools, such spools having a center longitudinal portion with a transversely extending planar flange mounted upon each end of the longitudinal portion. The apparatus includes a pair of movable jaw assemblies which first engage the center longitudinal portion of the spool and then expand to provide a rigid support adjacent the inner planar sufaces of the flanges of the spool. A hydraulic control system is provided which senses the fully extended engagement of the movable jaw assemblies with the spool and then actuates a hydraulic press to engage the outer surfaces of the flanges of the spool. The flanges of the spool are compressed between the movable jaw assemblies and the hydraulic press thereby straightening out irregularities in the flanges. A second sensing device detects when the hydraulic press has reached its fully extended position and then actuates a control system which retracts both the movable jaw assemblies and the hydraulic press, thereby releasing the spool and resetting the system for the next cycle.

It is therefore a general object of the present invention to provide an apparatus for straightening flanges upon spools.

A further object of the present invention is to provide an automated means for repairing metal flanges upon relatively large cylindrical spools in a rapid and economical manner.

Another object of the present invention is to provide an apparatus which will engage the center longitudinal portion of a cylindrical spool and then expand to provide a rigid support adjacent the inner planar surfaces of the flanges of said spool.

Yet another object of the present invention is to provide a wedge mechanism which converts a single horizontal motion of one component into both a horizontal and a vertical motion of a second component thereby providing a simple mechanism for first engaging the center longitudinal portion of a cylindrical spool and then engaging the inner planar surfaces of the flanges of said spool.

Yet a further object of the present invention is to provide a spool straightening apparatus with a "float" mounting so as to accommodate variations in the thickness of spool flanges.

An additional object of the present invention is to provide a spool straightener which can accommodate spools of varying lengths by means of a cylindrical spacer.

Other and further objects, features and advantages of the present invention will be readily apparent to those skilled in the art upon a reading of the description of the preferred embodiments which follows when taken in conjunction with the accompanying drawings.

DETAILED DESCRIPTION OF THE PREFERRED EMBODIMENTS OF THE INVENTION

Figure 1:
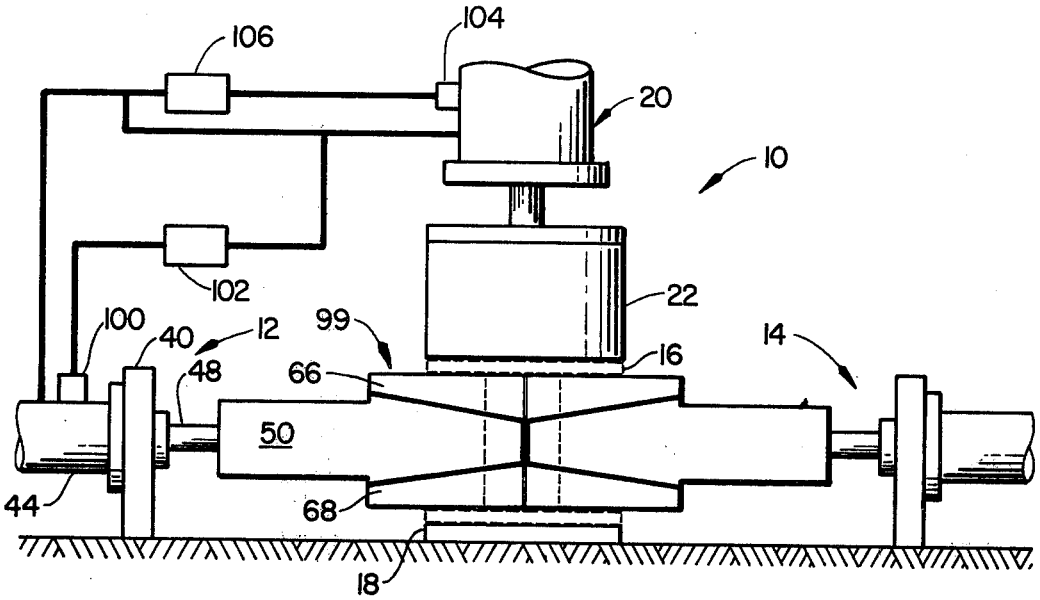
FIG. 1 is a partially schematic front elevation of the spool straightener of the present invention, showing the jaw assemblies in a fully extended and expanded position, and in place about a spool.

Referring now to the drawings and particularly to FIG. 1, the spool straightener of the present invention is illustrated and generally designated by the numeral 10. The spool straightener includes a first jaw assembly 12 and second jaw assembly 14. The jaw assemblies 12 and 14 are shown in their fully extended and expanded position, in place about a spool 16. The spool 16 is in place upon a base 18, and a force is exerted upon the outer planar surface of the upper flange of the spool 16 by means of the flange press 20 and the spacer 22. The spacer 22 is of a solid cylindrical configuration and is rigidly attached to the flange press 20.

Figure 2:
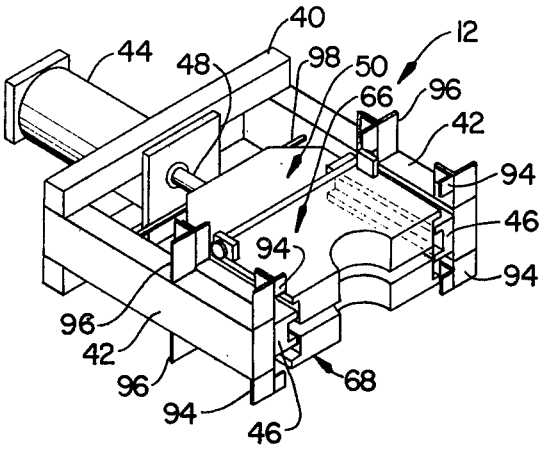
FIG. 2 is an oblique view of a jaw assembly in the fully retracted and collapsed position.

Referring to FIG. 2 the first jaw assembly of the present invention is illustrated and generally designated by the numeral 12. The first jaw assembly 12 and the second jaw assembly 14 are similar in construction. The jaw assembly 12 includes a frame 40 having a pair of horizontally disposed jaw support members 42 extended therefrom. Attached to the frame 40 is a first hydraulic ram 44, oriented parallel to the jaw support members 42. Attached to the inner surface of each of the jaw support members 42 is a wedge guide channel 46.

Figure 5:
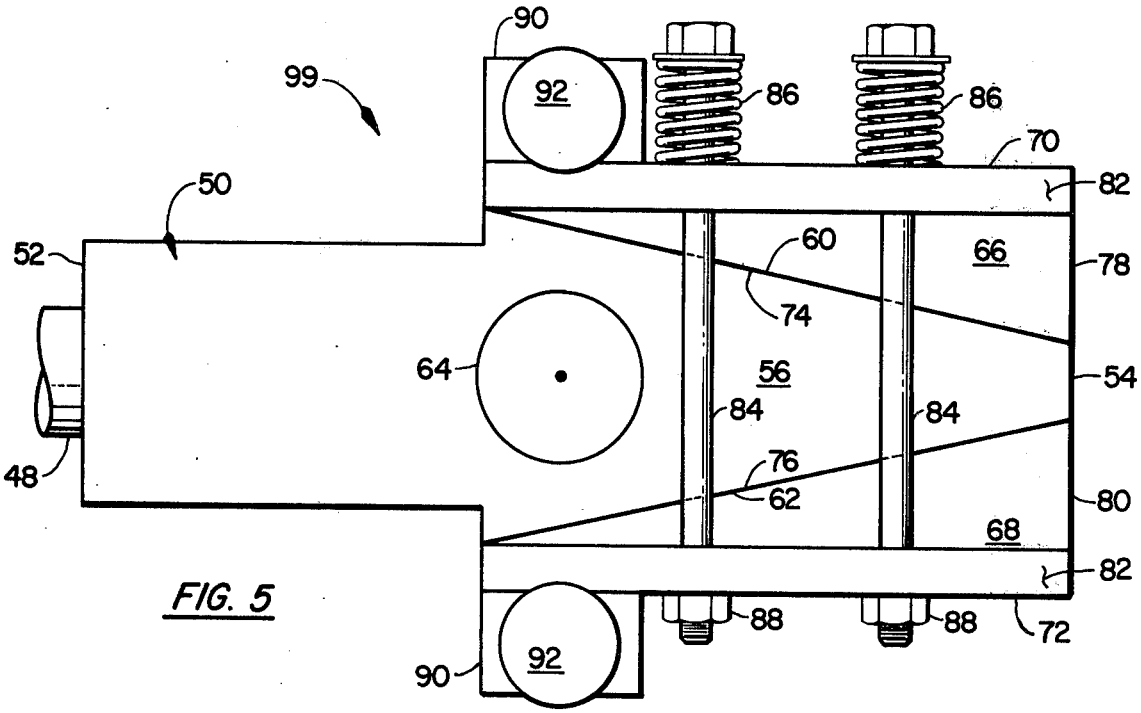
FIG. 5 is a side elevational view of the movable anvil of the present invention.

Extending from the first hydraulic ram 44 which acts as a wedge actuating cylinder, is a piston 48 to which is attached a wedge member 50, which lies in the horizontal plane defined by the jaw support members 42. The wedge member 50, as best seen in FIG. 5, has a rear end 52 to which the piston 48 is attached, a front end 54 for engaging the spool 16, a pair of vertical sides 56, an upper tapered surface 60, and a lower tapered surface 62.

To each of the vertical sides 56 is attached a wedge roller 64. Each of the rollers 64 engages the inner surface of one of the wedge guide channels 46. In this manner, as the piston 48 extends from the first hydraulic ram 44, the wedge 50 is translated in a horizontal direction and is guided in its motion by the wedge guide channels 46 and the rollers 64.

An upper jaw plate 66 and a lower jaw plate 68 are located above and below the wedge 50 in such a manner that the wedge 50 is partially sandwiched between the jaw plates 66 and 68. The jaw plates 66 and 68 have outer horizontal planar surfaces 70 and 72 respectively, for engaging the inner planar surfaces of the flanges of the spool 16. The jaw plates 66 and 68 have inner tapered planar surfaces 74 and 76 respectively, which slidingly engage and are partially coextensive with the upper and lower tapered planar surfaces 60 and 62 of the wedge 50. These sloped or tapered inner planar surfaces 74 and 76 describe a wedge shaped cavity tapered toward the spool engaging ends 78 and 80 of the jaw plates 66 and 68, respectively. The angle made up by the tapered sides of this wedge shaped cavity with a horizontal plane is the same angle as is described by the tapered surfaces 60 and 62 of the wedge 50 with a horizontal plane.

A horizontally extending planar lip 82 extends from either side of each of the jaw plates 66 and 68. Pairs of spaced concentric bolt holes (not shown) are contained in each lip 82 on each side of the jaw plates. There are two of these bolt holes in each lip thereby forming four pairs of concentric bolt holes. Within each pair of concentric bolt holes is placed a tension bolt 84. A coil spring 86 is placed between a head end of each tension bolt 84 and the adjacent lip 82. A threaded end of each tension bolt is then held in place by means of a nut 88. The resilient spring 86 is so constructed that it is in a state of compression thereby exerting a downward force upon the upper jaw plate 66 and an upward force transmitted through tension bolt 84 to the lower jaw plate 68. In this manner the upper jaw plate and the lower jaw plate are forcibly urged towards each other in a vertical direction and against the wedge member 50.

On either side of the outer horizontal planar surfaces 70 and 72 of the jaw plates are attached tabs 90. Attached to each of the tabs 90 is a jaw plate roller 92. To the upper and lower surfaces of the outer extremity of each of the jaw support members 42 are attached adjustable outer stop plates 94 which engage the rollers 92 when the jaw assembly 12 reaches a fully extended position. The stop plates 94 are adjustable in a horizontal direction parallel to the jaw support members 42 by means of a convention slot and bolt attachment (not shown). This allows the fully extended position of the jaw assembly 12 to be adjusted. The outermost extension of the horizontal translation of the jaw plates 66 and 68 is limited when the rollers 92 engage the outer stop plates 94. Note, however, that these outer stop plates 94 do not limit the horizontal translation of the wedge member 50.

The fully retracted and collapsed position of the jaw assembly 12 is shown in FIG. 2. Both the wedge member 50 and the jaw plates 66 and 68 are in their fully retracted position relative to the frame 40. The jaw plates 66 and 68 are in a totally collapsed position relative to each other due to the collapsing force exerted by the springs 86 through the tension bolts 84. Also the wedge member 50 is in a fully horizontally retracted position relative to the jaw plates 66 and 68.

Figure 3:
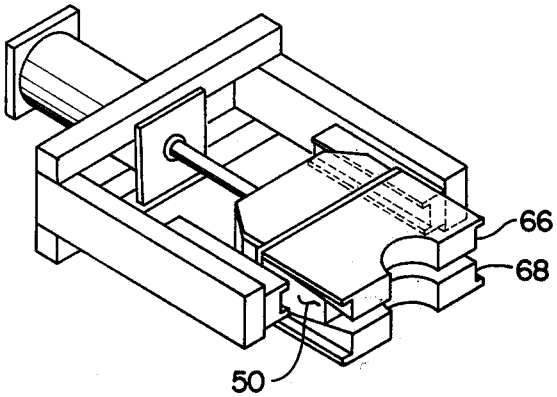
FIG. 3 is an oblique view of a jaw assembly in the fully extended and collapsed position.

As the piston 48 is extended from its fully retracted position of FIG. 2, the wedge 50 and the jaw plates 66 and 68 are translated horizontally away from the frame 40. The motion of the wedge 50 is guided by the rolling engagement of the wedge rollers 64 along the inner surfaces of the wedge guide channels 46. The fully horizontally extended position of the jaw plates 66 and 68 is defined by the point of engagement of the rollers 92 with the outer stop plates 94. Prior to engagement of the rollers 92 with the outer stop plates 94, the wedge member 50 and the jaw plates 66 and 68 do not move relative to each other. The jaw plates 66 and 68 are clamped to the wedge member 50 due to the force exerted by the springs 86 urging the jaw plates 66 and 68 towards each other. However, once the rollers 92 engage the outer stop plates 94, the horizontal motion of the jaw plates is ended. This is the fully extended and collapsed position as is shown in FIG. 3. The wedge member 50 then continues to move in a horizontally extending outward direction relative to the jaw plates 66 and 68. In this manner the wedge member 50 is forced between the jaw plates 66 and 68 and thereby causes the jaw plates to separate in a vertical direction, and further compresses the spring 86 increasing the forces exerted by the spring upon the jaw plates. As the jaw plates are forced apart, they move in a vertical direction relative to the frame 40. The rolling contact of the jaw plate rollers 92 along the outer stop plates 94 permits this vertical movement to occur. It is important that the contact between the jaw plates and the outer stop plates be a rolling contact as is herein provided. If this contact were merely a sliding contact, the vertical movement of the jaw plates would be hindered because of the high friction created due to the large force exerted upon the jaw plates, and accordingly, upon the outer stop plates 94, by the hydraulic ram 44.

Figure 4:
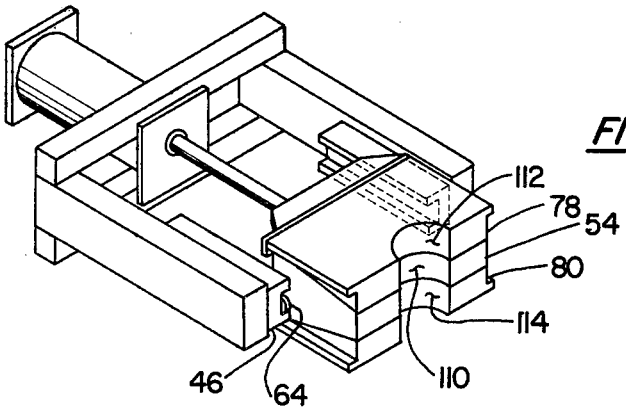
FIG. 4 is an oblique view of a jaw assembly in the fully extended and expanded position.

It is this vertical motion of the jaw plates relative to each other and to the wedge member which causes the outer horizontal planar surfaces 70 and 72 of the jaw plates to engage the inner horizontal planar surfaces of the flanges of the spool 16. When this point is reached the jaw assembly 12 is in the fully extended and expanded position as shown in FIG. 4. Both the wedge member 50 and the jaw plates 66 and 68 are in the fully extended position relative to the frame 40, and the jaw plates are in a fully expanded position relative to each other.

As the piston 48 is then retracted from the fully extended position of FIG. 4, the wedge member 50 and the jaw plates 66 and 68 are both translated horizontally towards the frame 40 and out of engagement with the spool 16. As the jaw plate rollers 92 disengage from the outer stop plates 94, the jaw plates collapse towards each other due to the forces exerted by the springs 86. This causes the jaw plates 66 and 68 to move in a horizontal direction away from the wedge member 50. In this manner the jaw plates return to a fully collapsed position. Also, inner stop plates 96 are provided at an intermediate location on the upper and lower surfaces of each jaw support member, for restricting the horizontal motion of the jaw plates towards the frame 40. In this manner, if the jaw plates should become stuck in their expanded position, i.e., if the force from the springs 86 should occasionally be insufficient to collapse the jaw plates, the retracting motion of the jaw plates will be limited by the inner stop plates 96, and the wedge member 50 will be withdrawn, thereby permitting the jaw plates to collapse. Additionally, a wedge member stop bar 98 is provided to limit the horizontal motion of the wedge member 50 towards the frame 40, thereby preventing the wedge member 50 from being completely withdrawn from between the jaw plates 66 and 68.

The combination of the wedge member 50 and the jaw plates 66 and 68 forms a movable anvil 99 which once in place adjacent the spool 16 provides rigid support to the inner planar surfaces of the flanges of the spool 16. Then when force is applied to the outer planar surfaces of the flanges of the spool 16 by means of the flange press 20, the base plate 18, and the spacer 22, the flanges of the spool are confined between the movable anvil 99 and either the spacer 22 or the base plate 18, and are thereby conformed to a relatively flat planar shape, removing warping, wrinkles, dents and the like, which the flanges have acquired through prior use.

An automated control system is provided for directing the motions of the various components of the spool straightening apparatus 10. Attached to the hydraulic system of the first hydraulic ram 44 is a first hydraulic pressure actuated switch 100 which detects when the wedge member 50 has reached a fully horizontally extended position by detecting a pressure rise within the hydraulic system of the first hydraulic ram 44. Connected to the switch 100 is a first control means 102 which is also connected to the hydraulic system of flange press 20 and which actuates the flange press 20 after the wedge member 50 has reached a fully extended position. Also included is a second hydraulic pressure actuated switch 104 which detects when the flange press 20 has reached a fully extended position by detecting a pressure rise within the hydraulic system of the flange press 20. The fully extended position of the flange press 20 is defined as the position where the flange press 20 has reached the end of its downward stroke as limited by contact with the spacer 22, or the spool 16 if no spacer is used. Connected to the second hydraulic pressure actuated switch 104 is a second control means 106 which when actuated by the second pressure actuated switch 104 causes the first hydraulic ram 44 and the flange press 20 which is a second hydraulic ram, to move out of engagement with the spool 16 and into position for another cycle.

Referring to FIG. 4 note the shape of the spool engaging ends 78 and 80 of the upper and lower jaw plates 66 and 68, respectively. Also note the shape of the front end or spool engaging end 54 of the wedge member 50. These spool engaging ends 54, 78 and 80 of the wedge member, upper jaw plate, and lower jaw plate, include semi-circular indentations 110, 112 and 114, respectively. When both of the jaw assemblies 12 and 14 are in their fully extended and expanded positions as is best shown in FIG. 1, then all the semi-circular indentations 110, 112 and 114 combine to form a cylindrical bore within which the center longitudinal portion of the spool 16 may fit, i.e., the cylindrical bore circumscribes the center longitudinal portion of the spool. It is not necessary that the cylindrical bore snugly engage the entire periphery of the center longitudinal portion of the spool, but it is desirable that the space around the center longitudinal portion of the spool, between it and the cylindrical bore, be as small as possible so that the supported area of the flanges of the spool is as large as possible.

It is to be understood that when the movable anvil 69 is said to be in an extended position so as to "engage" the center longitudinal portion of the spool 16, the term "engage" means that the movable anvils of each of the jaw assemblies 12 and 14 are in a fully extended position so that the center longitudinal portion of the spool is located within the cylindrical bore defined by the semi-circular indentations 112 and 114 of the upper and lower jaw plates 66 and 68, respectively. It is not required that the center longitudinal portion of the spool actually be contacted by the movable anvils in order for the anvils to "engage" the center longitudinal portion of the spool, although there generally will be at least a partial contact of the periphery of the center portion of the spool unless the spool happens to be exactly centered within the cylindrical bore defined by the semi-circular indentations 112 and 114. It therefore follows that the center longitudinal portion of the spool 16 is first "engaged" when the jaw assemblies 12 and 14 reach the fully extended and collapsed position as is shown in FIG. 3 for the first jaw assembly 12.

A major part of the inventive concept of the spool straightening apparatus of the present invention is the jaw assembly 12. It is noted that the inventive concept of the present invention could be executed through the means of a single jaw assembly 12 and a similar passive jaw assembly, in place of the second jaw assembly 14. The passive jaw assembly would be similar in operation to the jaw assembly 12 but it would be actuated by forces transmitted from the jaw assembly 12 through the wedge and/or jaw plates to the corresponding members of the passive jaw assembly, rather than being actuated by a separate hydraulic ram as is the second jaw assembly 14 in the presently described embodiment. Also the second jaw assembly 14 could be replaced with a fixed rigid jig which would merely engage the center longitudinal portion of the spool 16 and restrain it from moving in a horizontal direction while the spool straightening apparatus straightened one-half of the surface of the flanges of the spool 16. The spool 16 could then be rotated through 180° about the axis of its center longitudinal portion and then the other half of the flange areas could be straightened.

Figure 6:
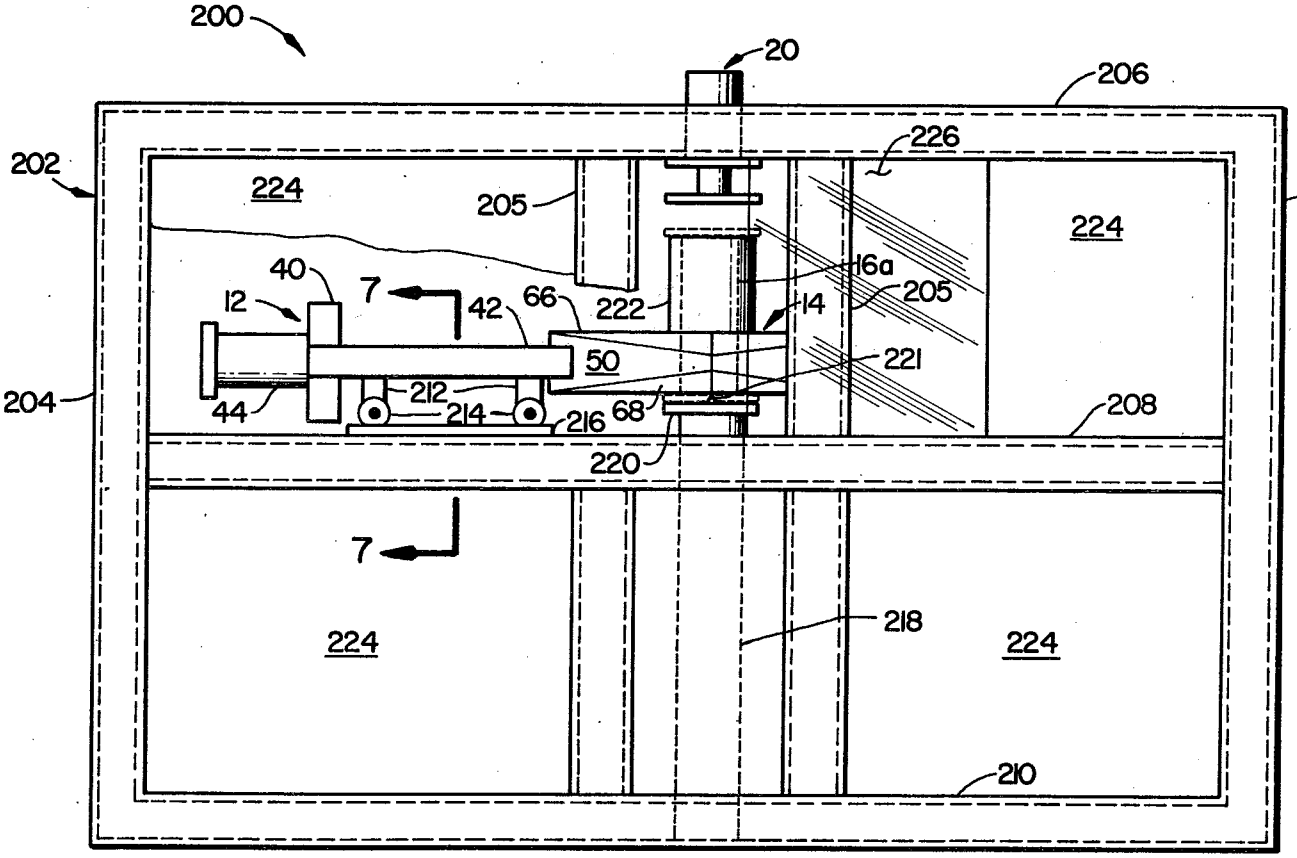
FIG. 6 is a partially cut-away front elevational view of a preferred embodiment of the apparatus of FIG. 1.

A preferred embodiment of the spool straightener of the present invention is that shown at FIG. 6, and generally designated by the numeral 200.

Figure 7:
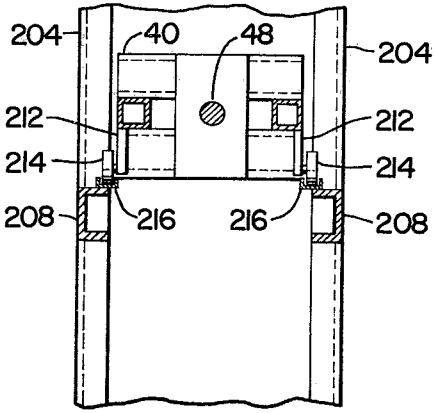
FIG. 7 is a sectional view taken along section 7—7 of FIG. 6.

The spool straightener 200 includes an outer frame 202, comprised of outer vertical members 204, inner vertical members 205, upper horizontal members 206, middle horizontal members 208, and lower horizontal members 210. Contained within the enclosure 202 are jaw assemblies like those described above. The first jaw assembly 12, is seen in FIG. 6 in its fully extended and expanded position. In this embodiment the jaw assembly 12 includes two spaced tabs 212 connected to the lower surface of each jaw support member 42. To each tab 212 is attached a floating roller 214. The rollers 214 rollably engage the inner surface of float channels 216, which are mounted upon the middle horizontal members 208. In this manner the jaw assembly 12 is supported within the outer frame 202 in a "floating" fashion, that is the jaw assembly 12 is not rigidly attached to the outer frame 202. The second jaw assembly 14 is "floated" in a similar manner. The "float" mounting of the jaw assemblies in best shown in FIG. 7.

This "floating" mounting of the jaw assemblies is provided to allow for variation in the thickness of the flanges of the spool 16*a*. The spool 16*a* is supported by a column 218 and support plate 220. It will be appreciated that when the jaw plates expand, and the lower jaw plate 68 contacts the inner planar surface of the lower flange of the spool 16*a*, an upward force will be exerted upon the lower jaw plate 68 by the spool 16*a*. The "float" mounting of the jaw assembly 12 permits the jaw assembly 12 to deflect in an upward direction without binding.

Extending from the upper surface of the support plate 220 is a spool centering stud 221. The centering stud 221 is of a conical configuration. It fits within a central bore within the lower flange of the spool 16*a* and thereby assists in centering the spool 16*a* upon the support plate 220.

It will be seen that the spool 16*a* is longer than the spool 16 of the previously described embodiments. The jaw assembly 12, in its fully expanded position, does not span the entire distance between the inner planar surfaces of the flanges of the spool 16*a*. Variations in the height of the spool 16*a* are accommodated by means of a split cylindrical spacer 222. The spacer 222 is split along a vertical plane perpendicular to the jaw support members 42. One semi-cylindrical half of the spacer 222 is mounted upon the upper jaw plate of the first jaw assembly 12, and the other half is mounted upon the upper jaw plate of the second jaw assembly 14. When the jaw assemblies are in their fully extended position, as shown in FIG. 6, the halves of the spacer 222 come together to form a cylinder. The split cylindrical spacer 222 has a bore therethrough, concentric and of equal diameter with the semi-circular indentations 112 and 114 (see FIG. 4) of the jaw plates.

The outer frame 202 includes removable cover panels 224 which cover those portions of the outer frame, as seen in FIG. 6, between the vertical and horizontal members 204, 205, 206, 208 and 210, except for that portion above the middle horizontal member 208 and between the inner vertical members 205. The top, sides and rear of the outer frame 202 are covered by similar panels. That portion of the outer frame 202 located above the middle horizontal member 208, and between the inner vertical members 205, as seen in FIG. 6, is covered by a transparent sliding door 226. The sliding door 226 preferably is provided with a safety starting interlock which prevents the hydraulic presses from being actuated when the door 226 is open.

In operation, a human operator opens the door 226, inserts a spool 16*a*, centering it upon the spool centering stud 221, closes the door 226 and actuates the hydraulic presses. The actual operation of the jaw assemblies and flange press is controlled by a hydraulic control system like that shown in FIG. 1, and previously described. The jaw assemblies and split cylindrical spacer extend so as to engage the center longitudinal portion of the spool 16*a*, and then expand vertically to provide a rigid support to the inner planar surfaces of the flanges of the spool 16*a*. Then the flange press 20 engages the outer planar surface of the upper flange of the spool and exerts a downward force thereon. The upper flange is confined between the flange press 20 and the spacer 222, and the lower flange is confined between the lower jaw plates 68 and the support plate 220. This compressional force on the flanges straightens any dents, warps or other irregularities therein. The jaw assemblies and flange press then retract and the operator opens the door 226, removes the spool, puts in another spool and starts the cycle again.

Thus, the spool straightening apparatus of the present invention is seen to be well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An apparatus for straightening a flange of a spool having a center longitudinal portion with a planar flange transversely mounted upon an end thereof, comprising:

a movable anvil, for engaging an inner planar surface of said flange; and means for moving said anvil, in a direction transverse to said inner planar surface, into and out of engagement with said inner planar surface.

2. An apparatus for straightening flanges of a spool having a center longitudinal portion with a planar flange transversely mounted upon each end thereof, comprising:

a frame;

movable anvil means extendably mounted upon said frame, for engaging the longitudinal portion of said spool and the inner planar surfaces of said flanges; and means attached to said frame for extending said movable anvil means relative to said frame to engage said longitudinal portion of said spool, and for moving said anvil means transversely to said inner planar surface to engage said inner planar surfaces of said flanges.

3. The apparatus of claim 2 further comprising:

a flange press for engaging the outer planar surface of one of said flanges.

4. The apparatus of claim 2 wherein the movable anvil means further comprises:

means for engaging the longitudinal portion of said spool; and means for rigidly engaging the inner planar surfaces of said flanges.

5. The apparatus of claim 2 wherein the movable anvil means further comprises:

a pair of jaw plates, each having an end surface for engaging the center longitudinal portion of the spool and each jaw plate having an outer planar surface oriented parallel to said flanges for engaging the inner planar surfaces of said flanges; and means for moving the jaw plates relative to each other, along an axis of translation parallel to the center longitudinal member, into rigid engagement with the inner planar surfaces of said flanges.

6. The apparatus of claim 5 wherein the means for moving the jaw plates is further comprised of:

a sloped surface upon an inner planar portion of each jaw plate, the sloped surfaces of the inner portions of the pair of jaw plates describing a wedge shaped cavity tapered towards the spool engaging end surface of the jaw plates;

a wedge member slidably engaging the sloped surfaces of the inner planar portions of the jaw plates; and means for forcing said wedge member between said jaw plates to force the jaw plates apart.

7. The apparatus of claim 6 further comprising a spring member connected to said jaw plates, to forcibly urge said jaw plates towards each other and against said wedge member.

8. The apparatus of claim 7 further comprising:

a flange press for engaging the outer planar surface of one of said flanges;

a base plate for engaging the outer planar surface of the other of said flanges;

means for detecting when said wedge member has reached a fully extended position; and control means, connected to said detection means, for actuating said flange press after said wedge member has reached a fully extended position.

9. The apparatus of claim 8 wherein:

said means for extending said movable anvil means further comprises a first hydraulic ram connected to said frame and said wedge member;

said flange press is further comprised of a second hydraulic ram;

said detection means is further characterized as including a switch actuated by a pressure rise within said first hydraulic ram; and said control means is further characterized as including means for varying the hydraulic pressure within said second hydraulic ram, in response to the position of said switch.

10. The apparatus of claim 9 which is further comprised of:

a second detection means for detecting when said second hydraulic ram has reached the end of its stroke; and a second control means, connected to said second detection means, for actuating retraction of both hydraulic rams.

11. A spool straightening apparatus comprising:

a jaw assembly having a frame and means extendably mounted upon the frame and movable transversely to an inner planar surface of a planar flange mounted upon each end of a center longitudinal portion of the spool, for engaging said inner planar surfaces.

12. The apparatus of claim 11 wherein said means for engaging the inner planar surfaces of the flanges of the spool is comprised of:

a pair of jaw plates, positioned to extend perpendicular to the center longitudinal portion of the spool, one end of each jaw plate being extendably connected to said frame, and the other end of each jaw plate having a semi-circular indentation for partially circumscribing the center longitudinal portion of the spool when the jaw plates are in a fully extended position.

13. The apparatus of claim 12 wherein the means for engaging the inner surface of the flanges is further comprised of:

a planar outer surface on each jaw plate, said planar surfaces of the jaw plates extending parallel to each other and positioned parallel to the spool flanges to be straightened;

a tapered inner surface on each jaw plate, said inner surfaces defining a wedge shaped cavity tapered toward the spool;

a wedge member, having tapered surfaces for concurrently engaging the inner tapered surfaces of the jaw plates; and means for extending the wedge member outward from the frame.

14. The apparatus of claim 13 wherein said means for extending the wedge member outward from the frame is comprised of:

a pair of longitudinal jaw support members, extending from said frame, so as to define a plane parallel to the flanges of the spool;

a wedge guide channel, attached to each jaw support member;

rollers, attached to the wedge member for engaging an inner surface of each wedge guide channel; and a hydraulic ram, attached to the frame, having a piston attached to the wedge member, so that as the piston is extended from the hydraulic ram, the wedge member is translated away from the frame and is guided by the rollers and wedge guide channels.

15. The apparatus of claim 14 further comprising means for resiliently urging the jaw plates together, thereby sandwiching the wedge member between the jaw plates.

16. The apparatus of claim 14 further comprising:

a lip extending from each side of the outer planar surfaces of each jaw plate, said lips having therein concentric opposed bolt holes, thereby comprising a pair of concentric opposed bolt holes on each side of the jaw plates;

a tension bolt disposed within each pair of concentric opposed bolt holes;

a compression spring attached to each tension bolt, between one of said lips and an end of the tension bolt, thereby providing a force urging the jaw plates together and sandwiching the wedge member therebetween.

17. The apparatus of claim 16 further comprising:

jaw plate rollers attached to either side of each jaw plate;

an outer stop plate, attached to each longitudinal jaw support member and positioned so that the jaw plate rollers contact the outer stop plates thereby limiting the extension of the jaw plates from the frame; and an inner stop plate, attached to each longitudinal jaw support member at a location between the frame and the outer stop plate, and positioned so that the jaw plate rollers contact the inner stop plates thereby limiting the inward retraction of the jaw plates toward the frame.

18. The apparatus of claim 15, further comprising:

a hydraulic flange press for engaging an outer planar surface of one of the flanges;

a base plate for engaging an outer planar surface of the other of the flanges; and a spool centering stud attached to the base plate for centering the spool thereon.

19. The apparatus of claim 18, further comprising:

a first hydraulic switch actuated by a pressure rise within the hydraulic ram attached to the wedge member;

a first control means, connected to the first hydraulic switch, for increasing the hydraulic pressure within the hydraulic flange press in response to the actuation of the first hydraulic switch;

a second hydraulic switch connected to the hydraulic flange press and actuated by a pressure rise within the hydraulic flange press; and a second control means, attached to the second hydraulic switch, and attached to the hydraulic ram and the hydraulic flange press, so that the pressure rise occuring in the hydraulic flange press, when it reaches a fully extended position actuates the second hydraulic switch and second control means, causing the hydraulic ram and the hydraulic flange press to be retracted.

20. The apparatus of claim 15, further comprising:

an outer frame having a pair of longitudinal horizontal members, located parallel to the longitudinal jaw support members;

a pair of float channels, one attached to each longitudinal horizontal member;

a pair of floating rollers attached to each longitudinal jaw support member, and rollably engaging the inner surface of one of the float channels, so that each longitudinal jaw support member is supported above one of the float channels by means of the pair of floating rollers.

21. The apparatus of claim 20, further comprising:

a second pair of float channels attached to the longitudinal horizontal members and longitudinally spaced from the first pair of float channels;

a second jaw assembly, similar to the first jaw jaw assembly and opposed thereto, the second jaw assembly being float mounted within the second pair of float channels, so that the first and second jaw assemblies extend towards each other to engage the spool located therebetween.

22. The apparatus of claim 21, further comprising a hydraulic flange press for engaging an outer surface of one of the flanges of the spool and a base plate for engaging an outer surface of the other flange of the spool.

23. The apparatus of claim 22 further comprising a cylindrical spacer attached to the hydraulic flange press.

24. The apparatus of claim 22 further comprising a split cylindrical spacer, one half of which is attached to each jaw assembly, so that when the jaw assemblies converge about the spool, the two spacer halves come together to form a cylinder.

25. Apparatus for removing anomalies from planar end flanges of wire and cable spools comprising:

a pair of jaw plates;

means for automatically moving the jaw plates first in the same direction into an engaging position adjacent the portion of the spool between the flanges and then in opposite directions from each other for contacting facing sides of the two flanges;

means movable toward one of the jaw plates in a direction directly opposite from the last mentioned direction of movement of said one jaw plate for contacting one of said flanges on the opposite side thereof from the facing side contacted by said one jaw plate; and means for synchronizing the movements of said movable means and said jaw plates to move said jaw plates to said position in which said jaw plates are in contact with the facing sides of the two flanges, and then to actuate and move said movable means into contact with said one flange, followed by movement of said movable means away from said one flange and movement of said jaw plates toward each other and out of contact with the facing sides of said flanges.

* * * * *